US005392587A

United States Patent [19]

Crouch

[11] Patent Number: 5,392,587

[45] Date of Patent: Feb. 28, 1995

[54] GRID FINGER ASSEMBLY

[75] Inventor: G. William Crouch, Colchester, Conn.

[73] Assignee: B & B Equipment, Inc., Middletown, Conn.

[21] Appl. No.: 64,943

[22] Filed: May 20, 1993

[51] Int. Cl.[6] ..... B65B 39/02

[52] U.S. Cl. ..... 53/248; 53/262

[58] Field of Search ..... 53/262, 261, 248, 247, 53/255, 539, 246

[56] References Cited

U.S. PATENT DOCUMENTS

| | | | |
|---|---|---|---|
| 2,540,743 | 2/1951 | Leach | 53/262 X |
| 3,057,136 | 10/1962 | Walter . | |
| 3,570,216 | 9/1971 | Frentzel | 53/248 |
| 3,965,650 | 6/1976 | Nussbaum | 53/248 X |
| 4,035,986 | 7/1977 | Clem et al. | 53/248 X |
| 4,075,819 | 2/1978 | Raudat et al. | 53/248 |
| 4,281,501 | 8/1981 | Rydell | 53/261 X |
| 4,300,330 | 7/1981 | Hartness | 53/539 |
| 4,325,208 | 4/1982 | Barker | 53/448 |
| 4,406,111 | 9/1983 | Raudat | 53/497 |
| 4,432,189 | 2/1984 | Raudat | 53/497 |
| 4,448,009 | 5/1984 | Raudat | 53/248 |
| 4,507,905 | 4/1985 | Goodell | 53/262 |
| 4,589,245 | 5/1986 | Kroeber et al. | 53/262 X |
| 4,608,804 | 9/1986 | Wild | 53/262 |
| 4,709,536 | 12/1987 | Hartness et al. | 53/539 |
| 4,726,167 | 2/1988 | Hartness | 53/248 |
| 4,833,860 | 5/1989 | Hartness | 53/261 |
| 4,835,946 | 6/1989 | Hartness et al. | 53/539 |
| 5,150,563 | 9/1992 | Hartness | 53/539 |
| 5,197,261 | 3/1993 | Hartness et al. | 53/534 |
| 5,212,932 | 5/1993 | Randat | 53/262 X |

*Primary Examiner*—James F. Coan

[57] ABSTRACT

A grid finger assembly for a carton filling machine has a finger holder having a body with a slot in one end thereof adapted to seat a grid element, a retainer cavity in its other end, and a multiplicity of finger receiving recesses extending axially into the body of the holder from the cavity and about its periphery. The body also has at least one retainer recess extending inwardly thereinto from the cavity and disposed inwardly of the finger receiving recesses. A multiplicity of elongated fingers formed from a flexible, form retaining synthetic resin, have a bifurcated end portion with spaced arms seated in the finger receiving recesses of the finger holder, and an elongated body portion depending therefrom and inclined outwardly from the axis of the finger holder. A retainer has its axis parallel to the axis of the holder and has one end dimensioned and configured to seat in the retainer cavity of the finger holder, and an axial projection seating in the retainer recess of the finger holder. The retainer also has projections about its periphery extending through apertures in the bifurcated end portions of the fingers to seat them thereon. A fastener releasably secures the retainer in the cavity with the projections on its periphery disposed therein to trap the bifurcated end portions of the fingers on the projections.

24 Claims, 8 Drawing Sheets

FIG. 2
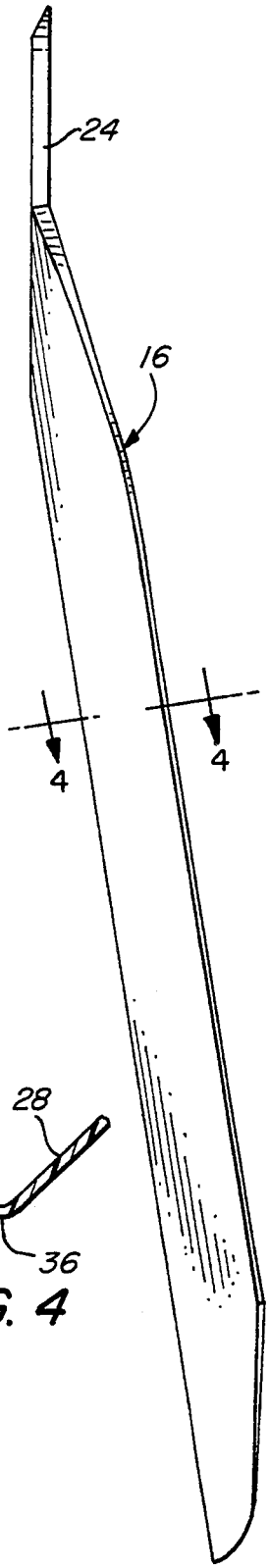
FIG. 3
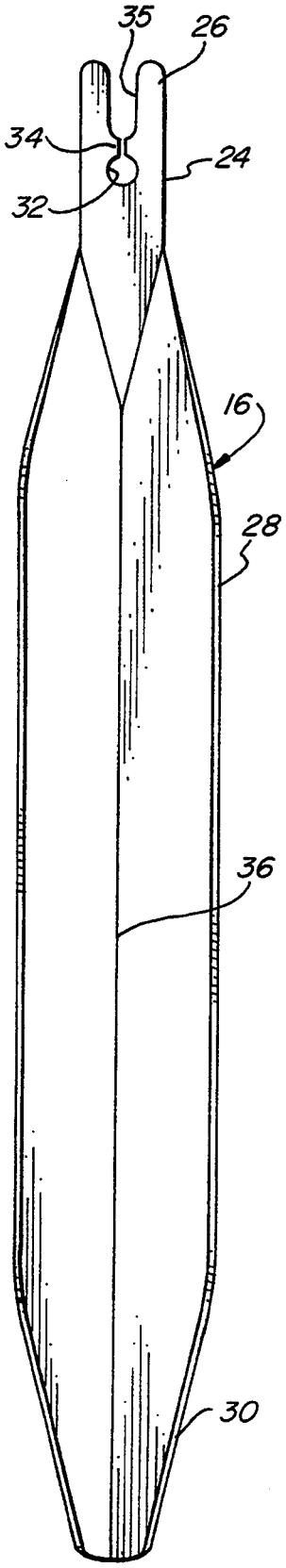
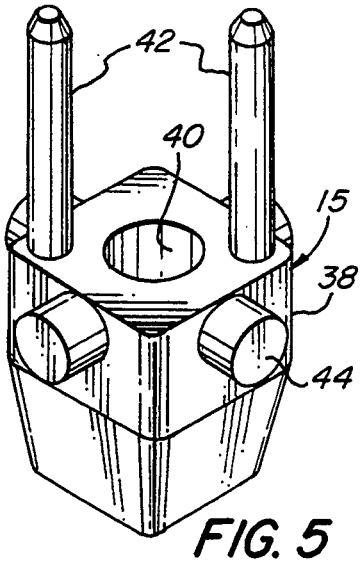
FIG. 5
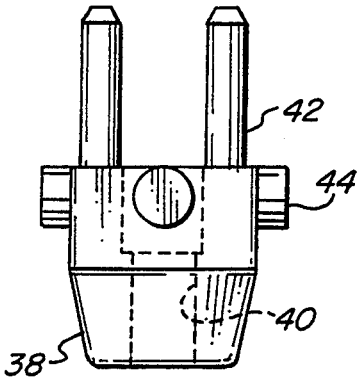
FIG. 6
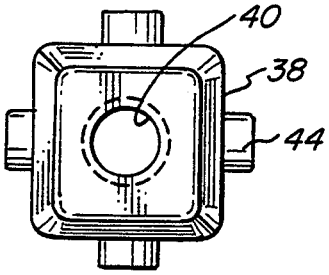
FIG. 7
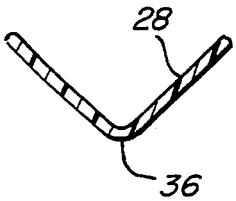
FIG. 4

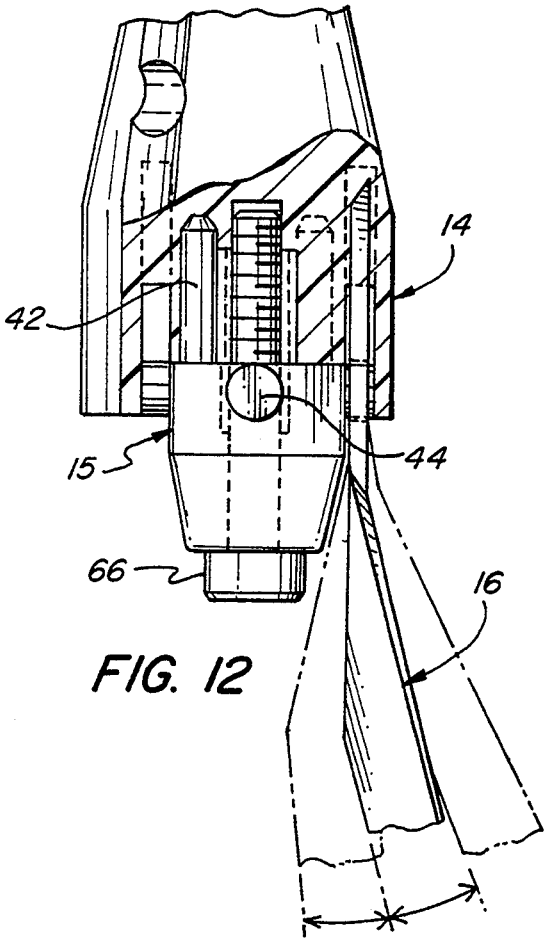
FIG. 12
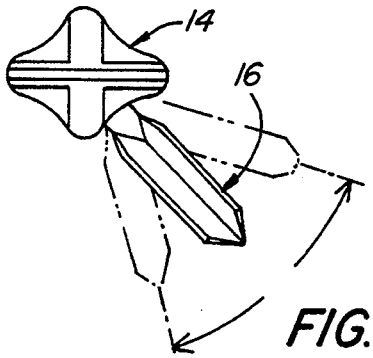
FIG. 14
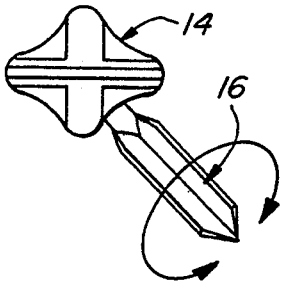
FIG. 15
FIG. 13A
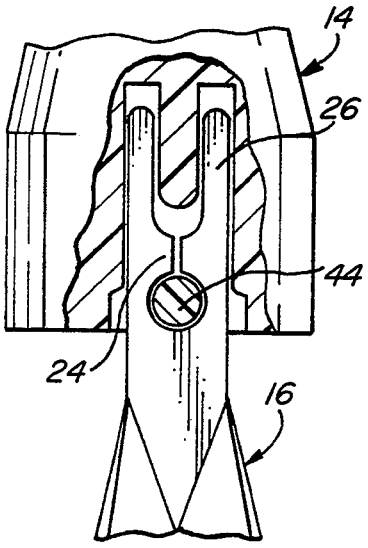
FIG. 13B
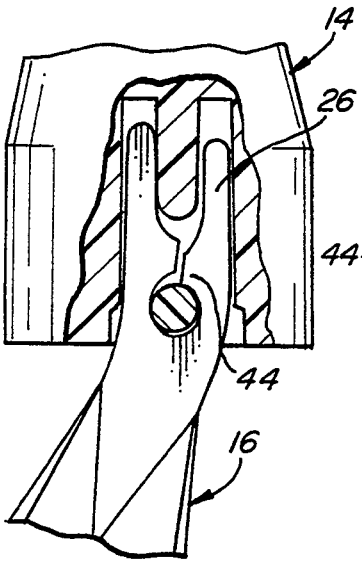
FIG. 13C
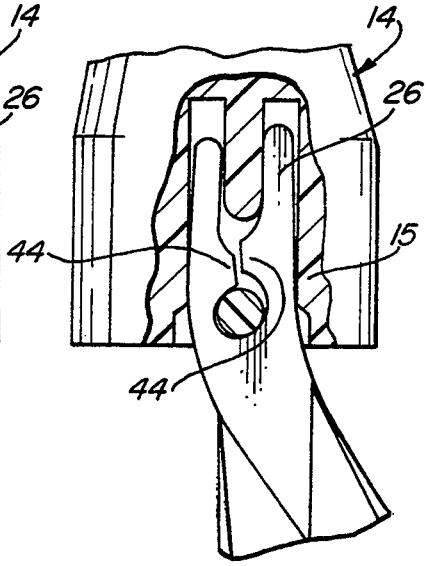

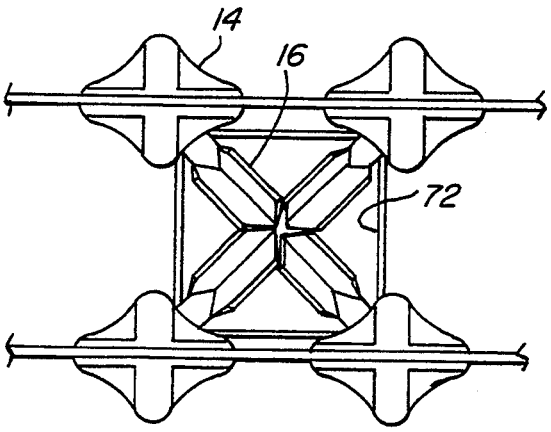
FIG. 16
FIG. 19
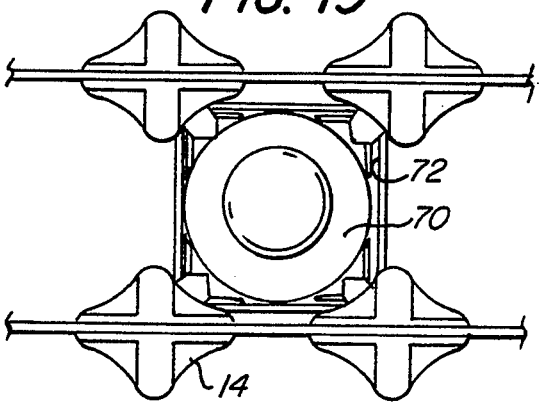
FIG. 17
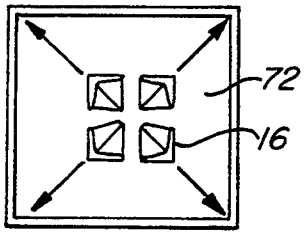
FIG. 21
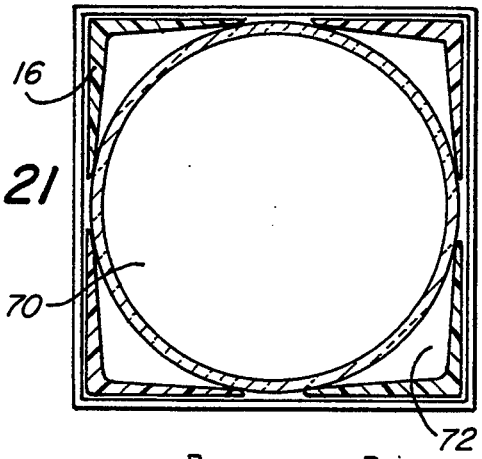
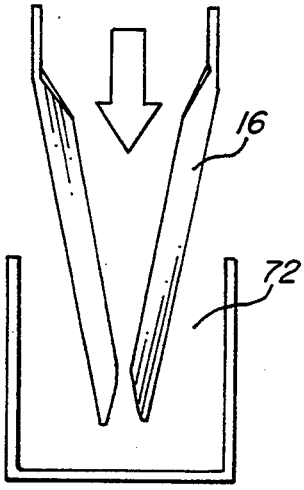
FIG. 18
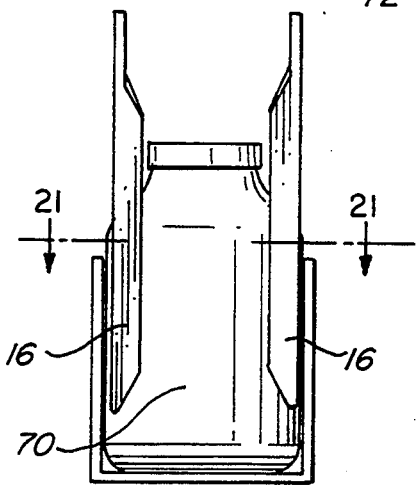
FIG. 20

FIG. 27
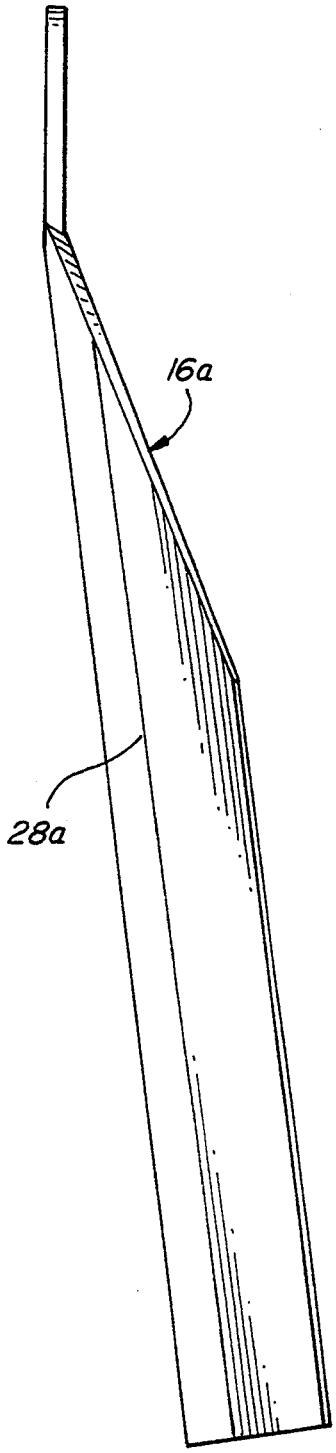
FIG. 26
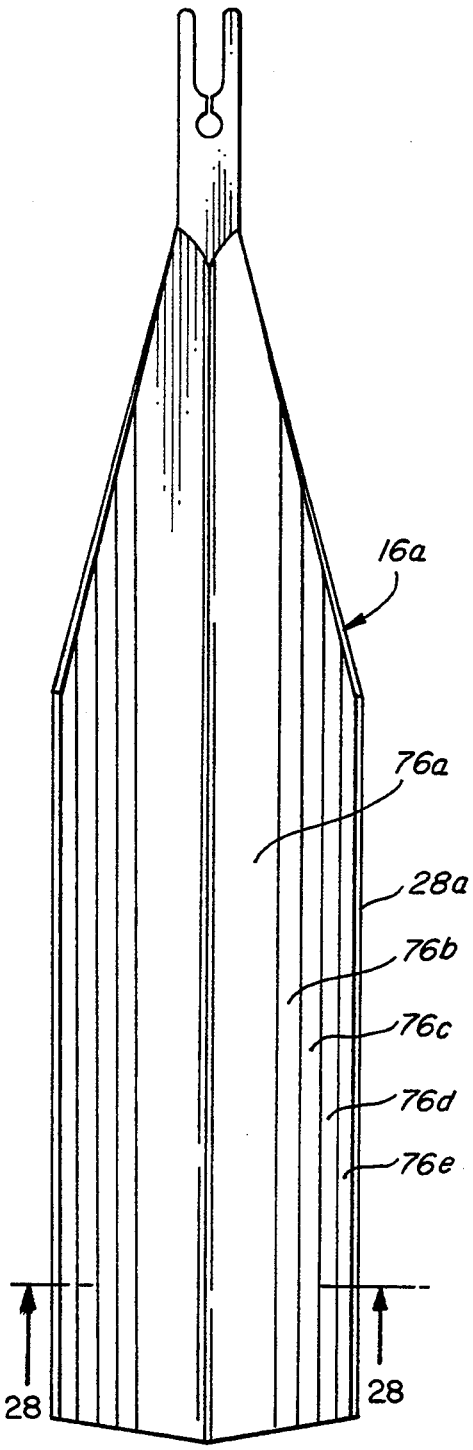
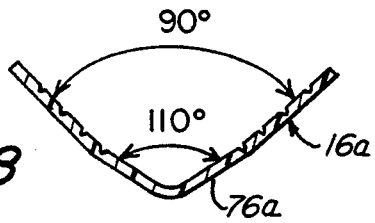
FIG. 28

GRID FINGER ASSEMBLY

BACKGROUND OF THE INVENTION

The present invention relates to carton loading equipment and, more particularly, to grid finger assemblies utilized for guiding containers from a lane in which they are travelling downwardly into compartments of a carton.

As is well known, many carton filling machines provide for movement of containers along lanes into a grid structure corresponding substantially to the compartments of a carton therebelow and into which the containers are to be loaded. Upon actuation of the machine, the containers are allowed to drop downwardly into the compartments of the carton. To guide the containers into the compartments, various types of structures have been proposed.

One of the most common systems utilized for guiding the containers into the carton compartments comprises a multiplicity of fingers which are deflected as the container moves downwardly and which are intended to guide the container into the center of the compartment in the carton. Some of these finger systems utilize separate springs to enhance or control the deflection of the fingers, and frequently the assemblies employ relatively complicated structures to secure the fingers in the holder which is mounted upon the carton loading machine. Some of the mounting arrangements are complex and require relative long downtime to change the fingers for different dimensions of containers or to replace broken fingers.

It is an object of the present invention to provide a novel grid finger assembly which provides a high degree of motion for the individual grid fingers to readily accommodate variations in dimensioning and misalignment of the containers and compartments.

It is also an object to provide such a grid finger assembly utilizing grid fingers which will exhibit relatively long life and minimize interference with the movement of the container into the compartment.

Another object is to provide such a grid finger assembly which may be readily assembled from its components and which may be readily manipulated to allow rapid exchange or replacement of the grid fingers.

A further object is to provide such a grid finger assembly in which the components may be readily and relatively economically fabricated and which will exhibit long life.

SUMMARY OF THE INVENTION

It has now been found that the foregoing and related objects may be readily attained in a grid finger assembly for a carton filling machine which includes a finger holder with a principal axis having a body with a slot in one end thereof extending along its principal axis and adapted to seat about a grid element, a retainer cavity in its other end, and a multiplicity of finger receiving recesses extending axially into the body of the holder from the cavity and about the periphery thereof. The body also has at least one retainer recess extending inwardly thereinto from the cavity and disposed inwardly of the finger receiving recesses, and fastening means are provided adjacent the one end of the holder for engaging it with the grid element seated in the slot.

A multiplicity of elongated fingers are formed from a flexible, form retaining synthetic resin and have (i) a bifurcated end portion with spaced arms seated in the finger receiving recesses of the finger holder, and (ii) an elongated body portion depending therefrom and inclined outwardly from the axis of the finger holder. A retainer has its axis parallel to the axis of the holder and having one end is dimensioned and configured to seat in the retainer cavity of the finger holder. The retainer also has an axial projection on the one end seating in the retainer recess of the finger holder and also has projections about its periphery extending transversely of the axis and through apertures in the bifurcated end portions of the fingers to seat them thereon. Releasable retainer engaging means secures the retainer in the cavity with the projections on its periphery also being disposed therein to trap the bifurcated end portions of the finger on the projections.

In the usual embodiments, four fingers are equiangularly disposed about the axis of the holder, and the body portions of the fingers are of generally V-shaped configuration with the apex of the V-shaped cross section diverging from the axis of the holder. Preferably, the finger includes a metallic spring element in the bifurcated end portion, and the finger is molded with the spring element therein.

Desirably, the other end portion of the fingers tapers to a reduced width at their lower ends, and the bifurcated end portions of the finger have a retainer aperture therein at the lower end of the arms and a relatively narrow channel extending from the aperture to a wider channel between the arms. This retainer aperture seats the projection on the retainer.

Preferably, the retainer has two axial projections on the one end seating in two retainer recesses in the holder, and the peripheral projections on the retainer are pins. The retainer engaging means comprises an elongated threaded fastener extending axially thereof and threadably and adjustably engaged in an axial recess in the holder. As a result, the fastener may be rotated to allow the retainer to move axially outwardly of the retainer cavity to permit replacement of the fingers on the projections thereof.

When utilized in a carton filling machine, there is a grid member comprised of a multiplicity of grid elements providing passages therebetween for containers to be packed in cartons provided with rectangular compartments dimensioned to receive the containers. A multiplicity of grid finger assemblies of the present invention is mounted upon the grid members and the fingers depend therefrom so as to guide the containers between the grid elements into the compartments of the carton.

BRIEF DESCRIPTION OF THE DRAWINGS

FIG. 2 is a side elevational view of a grid finger from an assembly of FIG. 1;

FIG. 3 is a front elevational view thereof;

FIG. 4 is a sectional view along the line 4—4 of FIG. 2;

FIG. 5 a perspective view of a retainer from the grid finger assemblies of FIG. 1;

FIG. 6 is a side elevational view thereof;

FIG. 7 is a side elevational view thereof;

FIG. 12 is a fragmentary view in partial section of a grid finger assembly with a single finger mounted therein and showing the flexing of the fingers by its positions in solid and phantom line;

FIGS. 13*a*–13*c* comprise fragmentary and partially exploded view of the assembly with a single finger showing the flexing of the grid finger about its retainer pin;

FIG. 14 is a top view of the assembly showing the side to side flexing of a finger;

FIG. 15 is a similar view diagrammatically showing by the double headed arrow, the rotational flexing of the finger;

FIG. 16 a fragmentary plan view of a grid assembly of a loading apparatus showing grid fingers of four grid finger assemblies cooperating to define a path for a container to pass through the grid into a compartment of a carton shown disposed therebelow;

FIG. 17is a diagrammatic view showing the manner in which the fingers of FIG. 16 will be deflected by a container passing therebetween;

FIG. 18 is a diagrammatic elevational view of the fingers before deflection;

FIG. 19 is a view similar to FIG. 16 showing the grid fingers moved outwardly into the corners of the compartment as the container passes downwardly therethrough;

FIG. 20 is a diagrammatic elevational view showing the container disposed within the compartment and showing the fingers flexed outwardly thereby;

FIG. 21 is a sectional view along the line 21—21 of FIG. 20;

FIG. 26 is a front elevational view of an as molded grid finger before custom sizing with a body having a compound angular cross section and axially extending scribe lines;

FIG. 27 is a side elevational view thereof;

FIG. 28 is a cross sectional view along the line 38—28 of FIG. 16;

DETAILED DESCRIPTION OF THE PREFERRED EMBODIMENT

Figure 1:
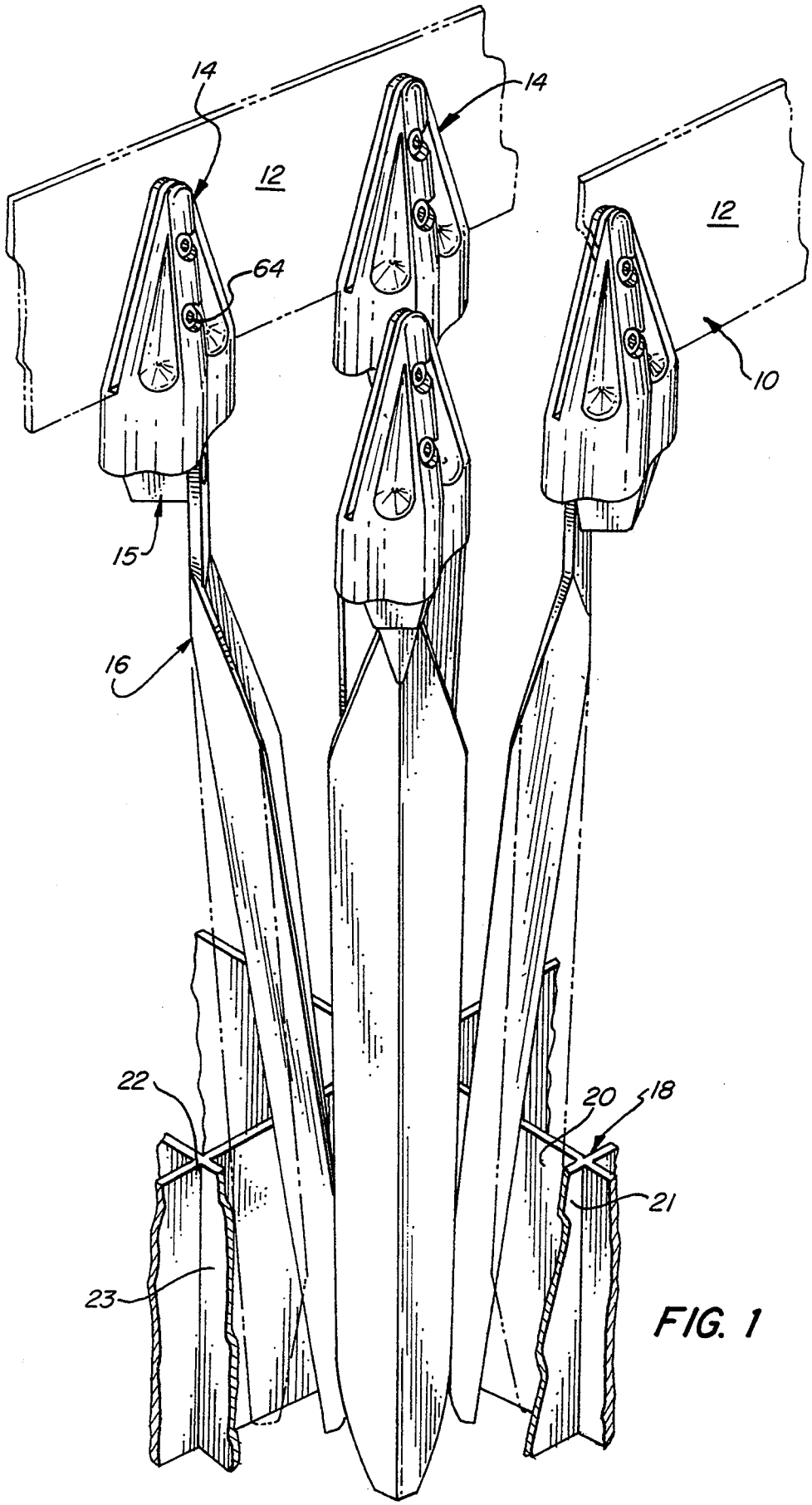
FIG. 1 is a fragmentary view of four grid finger assemblies with only one typically narrow width grid finger each, with the assemblies mounted upon two elements of a grid frame fragmentarily shown in phantom line, and showing fragmentarily a compartment of a carton into which a container is to be guided by the grid fingers.
Figure 8:
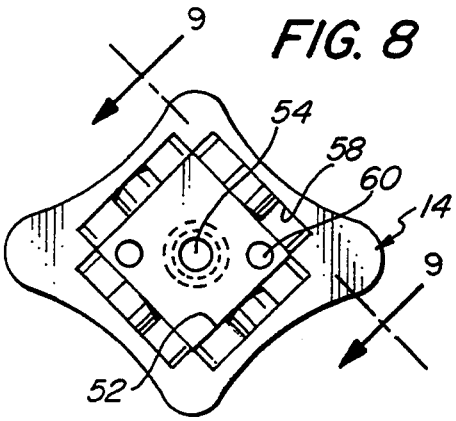
FIG. 8 is a bottom view of the finger holder from the assembly of FIG. 1.

Turning first to FIG. 1 therein fragmentarily illustrated in phantom line is a grid member generally designated by the numeral 10 and comprised of a pair of spaced grid elements 12. As is customary in the art, a multiplicity of parallel grid elements such as the elements 12 define lanes in which a multiplicity of containers move into alignment with the compartments of a carton disposed therebelow and, upon actuation of components (not shown) of the grid, are allowed to fall downwardly and be guided into the compartments of the carton which is generally designated by the numeral 18. The intersecting walls defining a single compartment are designated by the numerals 20, 21, 22 and 23.

Mounted on the divider elements 12 are four grid finger assemblies each comprised of a holder generally designated by the numeral 14 supporting therein a retainer generally designated by the numeral 15, and in which is mounted, for purposes of this illustration, only a single finger generally designated by the numeral 16. The fingers 16 of the four assemblies are shown in their at rest position wherein they extend at converging angles so that their lower ends are disposed closely and adjacent the center of the compartment.

Turning next to FIGS. 2–4, the fingers 16 have a bifurcated upper end portion 24 providing a pair of spaced arms 26 with a circular retainer cutout 32 therebetween at their base and a narrow channel 34 extending therefrom into the wider channel 35. The elongated body portion 28 is of generally V-shaped cross section and has a lower end portion 30 tapering to a reduced width. As can be seen in FIG. 2, the body portion 28 extends at an angle to the longitudinal axis of the bifurcated upper end portion 24.

Turning next to the retainer 15 which is shown in FIGS. 5–7, this integrally molded member has a body 38 of generally rectangular cross section with a circular passage 40 extending therethrough and a pair of diagonally spaced aligning pins 42 projecting upwardly from its upper surface. On each of its four sides, the body 38 has a horizontally extending mounting pin 44.

Figure 9:
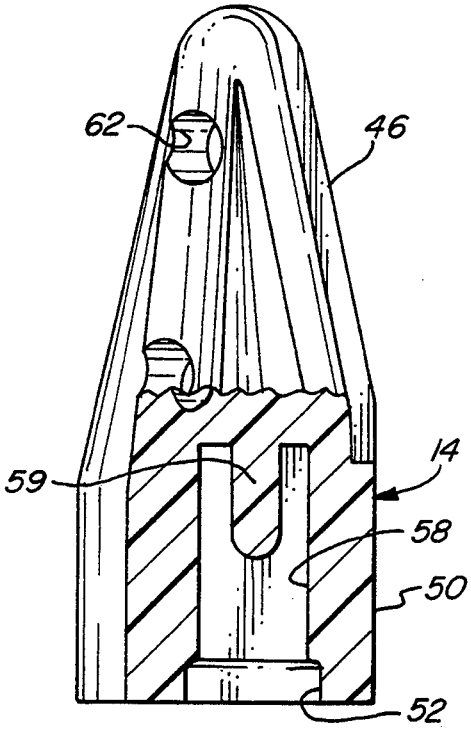
FIG. 9 is a side elevational view in partial section of the holder along, line 9—9 of FIG. 8.

The holder 14 is illustrated in detail in FIGS. 8–11 and has a tetralobal cross section with a body portion 50 and an upper end portion 46 of tapering cross section with an axial slot 48 therein. At the lower end of the body portion 50 is a retainer cavity 52 of rectangular cross section in which the body 38 of the retainer 15 seats. Extending axially upwardly from the cavity 52 is a pair of bores 60 which seat the aligning pins 42 of the retainer 15, a central bore 54 with a metallic threaded insert 56 molded therein seated in the lower end portion 50 seats one end of the helical compression spring 68, and its other end is seated in the enlarged end portion of the passage 40 in the retainer 15. As best seen in FIG. 9, four cavities 58 extend upwardly from the side margins of the cavity 52 and are configured to provide a depending divider 59 at their upper ends.

The upper end portion 46 of the holder 14 has an axially spaced pair of apertures 62 therein which seat the fasteners 64 seen in FIG. 1 to mount the holders 14 of the grid finger assemblies on the grid elements 12.

Figure 11:
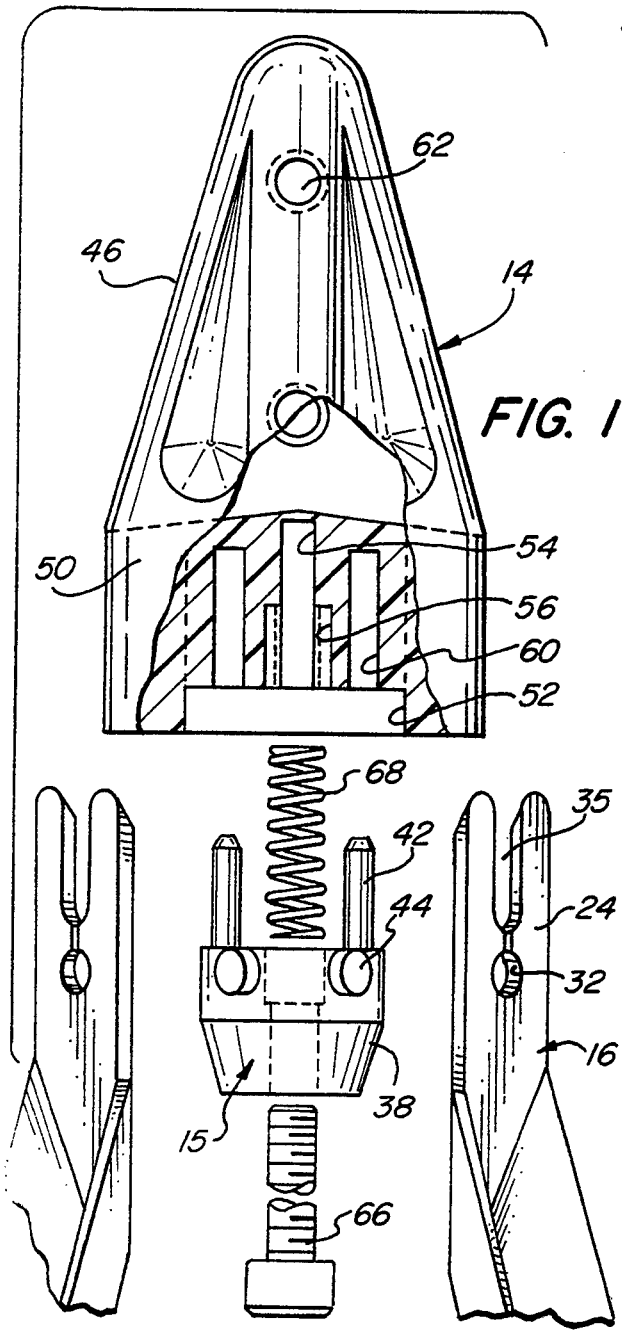
FIG. 11 is an exploded, partially sectional view of a grid finger assembly showing only two fingers.
Figure 10:
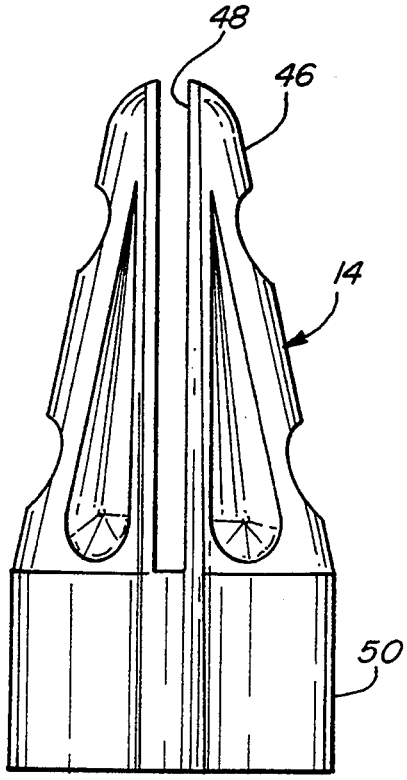
FIG. 10 is a side elevational view of the finger holder.

To effect the assembly as seen in FIGS. 11 and 12, the retainer 15 and its biasing spring 68 are aligned with the retainer cavity 52 and the threaded insert 56. The adjustable mounting fastener 66 is seated in the passage 40 of the retainer 15 and the aligning pins 42 are moved into the aligning pin recesses 60 of the holder 14. The fastener 66 is partially threaded into the threaded fastener recess 54 only a short distance so that the body 38 of the retainer 15 is below the cavity 52. The fingers 16 are assembled onto the retainer 15 with the mounting pins 44 extending through the apertures 32 therein.

The fastener 66 is then threaded fully into the fastener recess 54 causing the upper portion of the body 38 to move into the retainer cavity 52 and the end portions 24 to move into the recesses 58, thus trapping the end portions 24 of the fingers 16 in the cavity 52 and the finger receiving recesses 58.

As seen in FIGS. 12–15, the fingers 14 are resiliently deflectable so that they will pivot from their at rest position not only in a fore and aft direction as seen in FIG. 12 by the two phantom line showings, but also in a side-to-side direction as seen in FIGS. 13 and 14. They will also rotate to a limited extent as diagrammatically shown in FIG. 15.

As seen in FIG. 14, the pivoting in the fore and aft direction is primarily about the juncture between the body portion 28 and the bifurcated end portion 24. As seen in FIGS. 13*a*–13*c*, the side-to-side motion is effected by pivoting about the mounting pin 44 within the finger receiving recess 58 as reflected by the distortion of the axial position of the two arms 26 of the bifurcated end portion 24. The rotational motion indicated in FIG. 15 also tends to be about the area just below the mounting pin 44.

Figure 22:
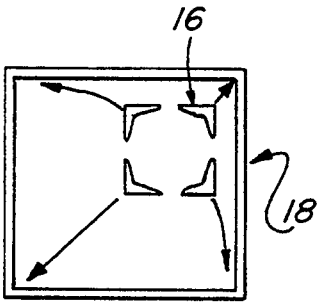
FIG. 22 is a view similar to FIG. 17 but shows the four grid fingers to guide the container offset relative to the center of the compartment and diagrammatically showing the manner in which the fingers will be deflected outwardly into the corners of the compartment.

As a result of the flexure enabled in this assembly, the fingers can accommodate not only a range of diameters for the containers passing therebetween, but also some misalignment between the nominal target center of a cluster of four fingers within the target compartment, such as seen in FIG. 22.

Figure 23:
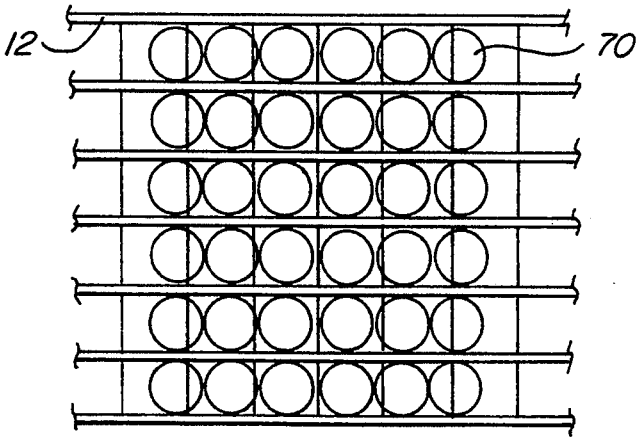
FIG. 23 is a diagrammatic elevational view of the lanes of a grid assembly showing containers moving therealong.

Turning next to FIGS. 16–21, therein illustrated is the typical operation of the fingers 16 of several grid finger assemblies to guide a container 70 into the compartment 72. Fingers 16 of four separate grid finger assemblies mounted on a grid element 12 extend downwardly and essentially centrally of the compartment 72 as a target cluster. When a group of containers 70 passing in a lane between the grid elements 12 as seen in FIGS. 23 are aligned above compartment 72, they are allowed to drop downwardly into the target cluster of grid fingers 16, and the weight of the container 70 will cause the grid fingers 16 to deflect outwardly towards the corners of the compartment 72 as seen in FIGS. 17, 18 and 19, thus allowing the container 70 to move into the compartment 72 as seen in FIGS. 20 and 21.

In the condition indicated in FIG. 22, the center of the finger target cluster is not ideally centered in the compartment 72, the orbital motion capability of the fingers 16 as well as their fore and aft flexure and V-shaped cross section enables the fingers 16 to deflect to the extent necessary to move into the corners of the compartment 72, thus providing the necessary guidance of the container into the centered position shown in FIGS. 19-21. Misalignment of the target cluster of fingers 16 will generally occur due to the accumulation of variations in the thickness of the partitioning walls of the carton and container clearances, as is quite common in such packaging operations.

Figure 24:
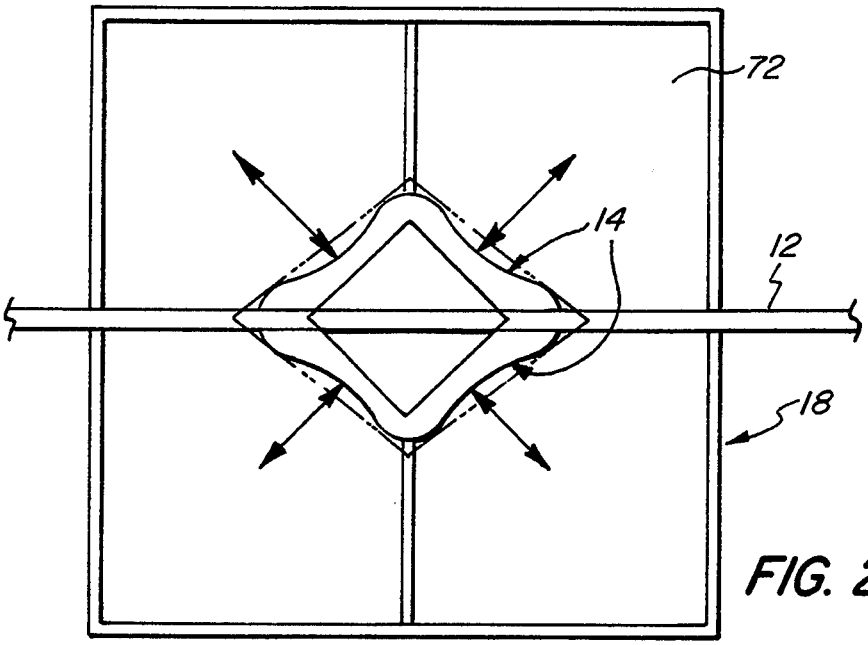
FIG. 24 is a partially diagrammatic view of a single cell/finger holder assembly showing the manner in which the four fingers of a single finger assembly will function in four different compartments and be deflected inwardly into the corners of the four separate compartments during guidance of containers thereinto.
Figure 25:
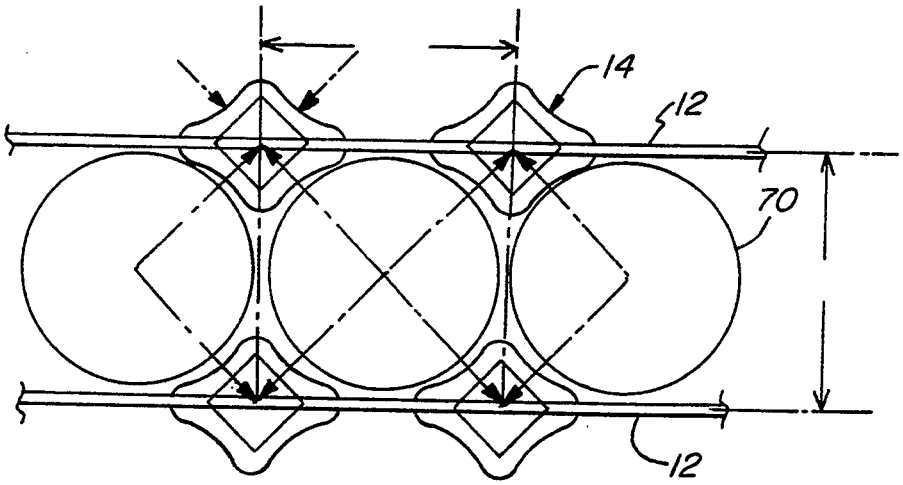
FIG. 25 shows a series of four grid finger assemblies mounted on a pair of grid elements and showing diagrammatically the manner in which the grid fingers of the different assemblies cooperate to guide containers into adjacent compartments.

Turning now to FIGS. 24 and 25, a typical grid finger arrangement is shown. As seen in FIG. 24, the holder 14 of a grid finger assembly (the fingers are not shown) is mounted on a grid element 12 and the four fingers will be disposed in four separate compartments to provide one finger of each target cluster. As seen in FIG. 25, four grid finger assemblies cooperate to provide the four finger target cluster for each compartment.

Turning now to FIGS. 27 and 28, therein illustrated is the full sized as molded embodiment for the configuration of the fingers 16a. As best seen in FIGS. 26 and 28, the cross section of the body portion 28*a* is defined by a series of axially extending scribe lines 76*b*–76*e* to provide width varying selection lines for the customizing of the width of the fingers to the width of the containers with which they will be used. As is illustrated by FIG. 28, the V-shaped cross section is provided by a compound angle of which the included angle for the segment 76*a* is 110° and the included angle of the segments extending therefrom approximates 90°.

Figure 31:
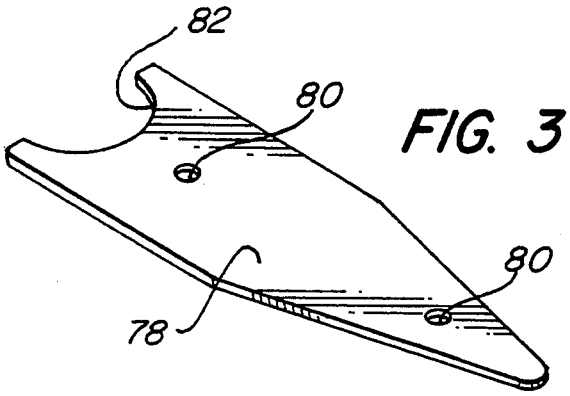
FIG. 31 is a perspective view of the spring element.
Figure 29:
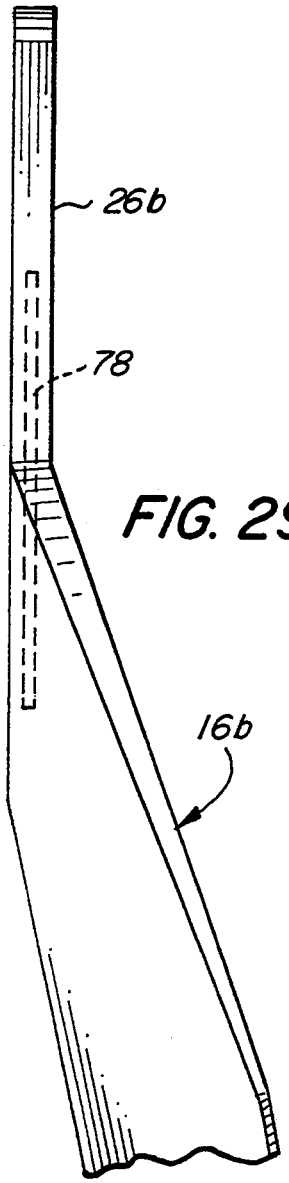
FIG. 29 is a fragmentary side elevational view of a finger with a metallic spring element molded therein.
Figure 30:
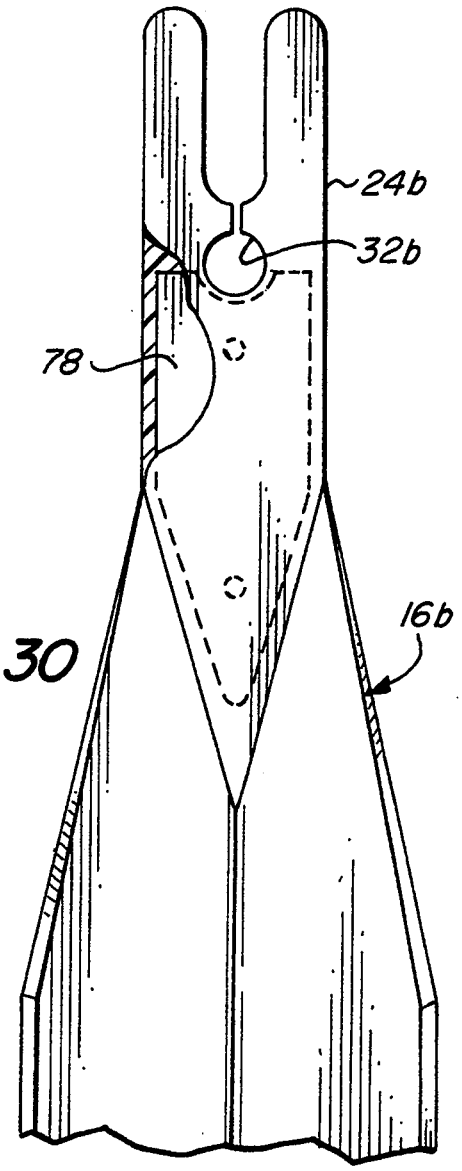
FIG. 30 is a fragmentary front elevational view in partial section of the finger in FIG. 29.

Turning now to FIGS. 29–31, therein illustrated is a construction for a preferred finger 16*b* in which there is molded into the bifurcated end portion 24 a metal spring insert 78 which has a arcuate notch 82 in its upper end to conform substantially to the aperture 32*b* in the synthetic resin finger and a pair of axially spaced apertures 80 which facilitate holding the spring into the molding tool cavity and locating it accurately within the bifurcated end portion 24. The use of such a spring metal insert greatly increases the fatigue resistance of the finger 16 and provides increased life.

As will be readily appreciated, the width and length of the fingers will vary depending upon the dimensions of the containers to be received therein. Moreover, the width may also be selected to provide maximum protection for glass containers and labels on the containers as they move downwardly into the carton compartment by providing a smooth surface against which they slide and a maximum amount of container protection relative to the selection of an appropriate width which will afford optimum coverage.

If the width of the finger selected is too great, they may exceed the tolerance - the spacing of the carton compartment relative to the periphery of the container and produce interference as the container moves downwardly into the compartment. Thus, some degree of variation in the fingers will normally be required to accommodate variations in the dimensions of the containers and of the cartons with which the finger assemblies are to be employed in a particular carton filling machine.

Although the fingers have been illustrated as having a generally V-shaped cross section, the juncture between the two axial segments providing the body portion of the fingers should be arcuate or rounded to avoid the stiffening which would be characteristic of a sharp 90° angle between the two axially extending segments. Generally, the angle included between the inside surfaces of the two most inwardly axially extending segments of the body portion will be in the neighborhood of 110° and between the outer segments, 90° as seen in FIG. 28. The combination of rounded center juncture with a compound angle for the axial segments and a flexible resin composition creates a shape that will tolerate severe abuse by deflection away from excessive contact force in any direction, without producing damage to he fingers.

Exemplary of the dimensioning of the fingers for different diameter and length containers are the following:

| Diameter Container | Width of Finger Body Portion |
|---|---|
| Up to 2¾" | 1½" |
| 2¾"–3¼" | 1¾" |
| 3½"–3¾" | 2" |
| 4"–4¼" | 2½" |
| 4½" & Up | 3" |

The resin formulation employed for the fingers should provide a high degree of flexibility, fatigue resistance and chemical resistance. A preferred composition is a polyacetal blend of the resins sold by E. I. dupont under the designation DELRIN and the resin sold by Hoechst Celanese under the designation CELCON. Although not as desirable, these and other acetal resins may be utilized singly, as may other resins such as polyamides, polypropylene, rubbing ethylene/propylene terpolymers and the like.

When a spring steel insert of the type shown in FIGS. 29–31 is employed, it is conveniently of a thickness of about 0.015–0.030 inch. The alloy employed for the spring is one which should provide a high degree of fatigue resistance such as a copper/beryllium alloy. The mold in which the resin is formed about this spring component should provide support for the spring to maintain it essentially in the center of the thickness of the resin molded thereabout.

The retainer and holder are conveniently integrally molded from a resin providing high impact resistance, good durability and fatigue resistance, particularly for the retainer pins. WSuitable resins include acrylonitrile/butadiene/styrene (ABS) polymers, acetals, polyamides, polycarbonates and polypropylene.

It will be readily appreciated from the foregoing description and attached drawings, the fingers of the present invention can bend fore and aft as a result of the spring action as well as side-to-side and orbitally to a limited degree. This enables the fingers to accommodate misalignment relative to the center of the compartment and misalignment of the container as it is dropping therethrough. The fingers will move outwardly into the corners of the compartment so as to provide minimal interference to the movement of the container into the compartment and also potential damage to the label applied to the container. Since they are relatively thin and flex in fashion indicated, and move to vacant corner positions of the compartments, the interference of the fingers between the periphery of the container and compartment wall is minimal.

It will also be appreciated that the fingers may be readily changed, as a result of wear resulting from extended wear resulting from extended usage or the need to change the finger dimensioning as the size of the containers being handled is varied. To do so, the fastener for the retainer is loosened to allow the retainer pins to move below the holder. At this point, the old fingers can be removed from the mounting pins and new fingers placed thereon. The retainer screw can then be tightened to firmly engage the new fingers in the holder. Moreover, the finger assembly itself may be removed readily by removing the two screws which fasten it to the grid elements.

The configuration of the bifurcated end portion of the finger is considered to be quite critical to the desired performance. The narrow channel running between the mounting pin aperture to the wider channel between the two elongated arms can conveniently be described as a flex groove or channel. The mounting pin aperture in the bifurcated end portion is larger than the diameter of the mounting pin with a clearance of approximately 1/16 inch to allow substantial movement and deflection of the bifurcated end portion about the mounting pin. The narrow channel or flex groove provides additional flexure and enables the two arms to move relative to each other about the mounting pin as shown in FIGS. **13*a*–13c. In addition, it should be noted that the dimensioning of the finger receiving recesses 58** in the holder provides sufficient clearance for the relative movement of the arms of the bifurcated end portion therein to enable the various flexing and torsional motions.

It will also be appreciated that the design of the fingers provides an offset transition from the bifurcated end portion into the body portion, and it is responsible for the proper targeting or angular projection from the holder to the lower tips of the fingers whereby the fingers will reach to the center of a compartment based strictly on the offset angle and without the need of other elements to effect this angular orientation. Additional deflection with improved fatigue resistance can be achieved through a slight bending of the metal spring embedded therein, which reduces the resin in the greatest flexure.

The tetralobal holder configuration is also beneficial from the standpoint of providing initial guidance for the containers as they drop from the lanes in which they have been moving. The lobes taper outwardly downwardly and are scalloped to conform to, and better accommodate, the round container shapes which will pass thereby. This resulting parallelogram configuration places the holder recesses in proper relationship to the container within the grid.

Thus, it can be seen from the foregoing detailed description and attached drawings that the present invention provides a novel grid finger assembly for use in automatic carton loading equipment. The grid finger assemblies cooperate to center the container passing therebetween relative to the compartment in which it is to be located. The flexure of the fingers themselves in several directions enables them to accommodate some degree of misalignment and variation in dimensioning of the containers and of the compartments. The method of assembling the components to provide the grid finger assembly enables facile exchange of fingers of different dimension or replacement of fingers which may become worn.

Having thus described the invention, what is claimed is:

1. A grid finger assembly for a carton filling machine comprising:

(a) a finger holder with a principal axis and having a body with a slot in one end thereof extending along its principal axis and adapted to seat about an associated grid element, a retainer cavity in its other end, and a multiplicity of finger receiving recesses extending axially into the body of said holder from said cavity and about the periphery thereof, said body also having at least one retainer recess extending inwardly thereinto from said cavity and disposed inwardly of said finger receiving recesses;

(b) fastening means adjacent said one end of said holder for engaging said holder with the associated grid element seated in said slot;

(c) a multiplicity of elongated fingers formed from a flexible, form retaining synthetic resin, said fingers having (i) a bifurcated end portion with spaced arms seated in said finger receiving recesses of said finger holder, (ii) an elongated body portion depending therefrom and inclined outwardly from said axis of said finger holder;

(d) a retainer having its axis parallel to said axis of said holder and having one end dimensioned and configured to seat in said retainer cavity of said finger holder, said retainer having an axial projection on said one end seating in said retainer recess of said finger holder, said retainer also having projections about its periphery extending transversely of said principal axis and through apertures in said bifurcated end portions of said fingers to seat them thereon; and (e) releasable retainer engaging means securing said retainer in said cavity with said projections on its periphery also being disposed therein to trap said bifurcated end portions of said finger on said projections.

2. The grid finger assembly in accordance with claim 1 wherein four fingers are equiangularly disposed about said axis of said holder.

3. The grid finger assembly in accordance with claim 1 wherein said body portions of said fingers are of generally V-shaped configuration with the apex of the V-shaped cross section diverging from said axis of said holder.

4. The grid finger assembly in accordance with claim 1 wherein said finger includes a metallic spring element in said bifurcated end portion.

5. The grid finger assembly in accordance with claim 1 wherein said finger is molded with said spring element therein.

6. The grid finger assembly in accordance with claim 4 wherein said finger has its other end portion tapering to a reduced width at its lower end.

7. The grid finger assembly in accordance with claim 1 wherein said bifurcated end portion of said finger has a retainer aperture therein at the lower end of said arms and a relatively narrow channel extending from said aperture to a wider channel between said arms, said retainer aperture seating said projection on said retainer.

8. The grid finger assembly in accordance with claim 1 wherein said retainer has two axial projections on said one end seating in two retainer recesses in said holder.

9. The grid finger assembly in accordance with claim 1 wherein said peripheral projections in said retainer are pins.

10. The grid finger assembly in accordance with claim 1 wherein said retainer engaging means comprises an elongated threaded fastener extending axially thereof and threadably and adjustably engaged in an axial recess in said holder, whereby said fastener may be rotated to allow said retainer to move axially outwardly of said cavity to permit replacement of said fingers on said projections thereof.

11. A grid finger assembly for a carton filling machine comprising:

(a) a finger holder with a principal axis and having a body with a slot in one end thereof extending along its principal axis and adapted to seat about an associated grid element, a retainer cavity in its other end, and a multiplicity of finger receiving recesses extending axially into the body of said holder from said cavity and about the periphery thereof, said body also having at least one retainer recess extending inwardly thereinto from said cavity and disposed inwardly of said finger receiving recesses;

(b) fastening means adjacent said one end of said holder for engaging said holder with the associated grid element seated in said slot;

(c) four elongated fingers equiangularly disposed about said holder and formed from a flexible, form retaining synthetic resin, said fingers having (i) a bifurcated end portion with spaced arms seated in said finger receiving recesses of said finger holder, (ii) an elongated body portion depending therefrom and inclined outwardly from said axis of said finger holder, said body portions of said fingers being of generally V-shaped configuration with the apex of the V-shaped cross section diverging away from said axis of said holder, said fingers including a metallic spring element in said bifurcated end portion, said fingers having the other end portions tapering to a reduced width at their lower end;

(d) a retainer having its axis parallel to said axis of said holder and having one end dimensioned and configured to seat in said retainer cavity of said finger holder, said retainer having an axial projection on said one end seating in said retainer recess of said finger holder, said retainer also having four projections equiangularly spaced about its periphery extending transversely of said principal axis and through apertures in said bifurcated end portions of said fingers to seat them thereon; and (e) releasable retainer engaging means securing said retainer in said cavity with said projections on its periphery also being disposed therein to trap said bifurcated end portions of said fingers on said projections, said retainer engaging means comprising an elongated threaded fastener extending axially thereof and threadably and adjustably engaged in an axial recess in said holder, whereby said fastener may be rotated to allow said retainer to move axially outwardly of said cavity to permit replacement of said fingers on said projections thereof.

12. The grid finger assembly in accordance with claim 11 wherein said bifurcated end portion of said fingers has a retainer aperture at the lower end of said arms and a relatively narrow channel extending from said aperture to a wider channel between said arms, said retainer aperture seating said projection on said retainer.

13. The grid finger assembly in accordance with claim 11 wherein said finger is molded with said spring element therein.

14. The grid finger assembly in accordance with claim 11 wherein said retainer has two axial projections on said one end seating in two retainer recesses in said holder and wherein said peripheral projections are pins.

15. In combination for use in a carton filling machine, (a) a grid member comprised of a multiplicity of grid elements providing lanes therebetween for containers to be packed in associated cartons provided with rectangular compartments dimensioned to receive the containers therein;

(b) a multiplicity of grid finger assemblies mounted upon said grid member and depending therefrom, each assembly comprising:

(i) a finger holder with a principal axis and having a body with a slot in one end thereof extending along its principal axis and seating a grid element therein, a retainer cavity in its other end, and a multiplicity of finger receiving recesses extending axially into the body of said holder from said cavity and about the periphery thereof, said body also having at least one retainer recess extending inwardly thereinto from said cavity and disposed inwardly of said finger receiving recesses;

(ii) fastening means adjacent said end of said holder engaging said holder to said grid elements seated in said slot;

(iii) four elongated fingers equiangularly disposed about said holder and formed from a flexible, form retaining synthetic resin, said fingers having (i) a bifurcated end portion with arms seated in said finger receiving recesses of said finger holder, (ii) an elongated body portion depending therefrom and inclined outwardly from said axis of said finger holder, said body portions of said fingers being of generally V-shaped configuration with the apex of the V-shaped cross section diverging away from said axis of said holder;

(iv) a retainer having its axis parallel to said axis of said holder and having one end dimensioned and configured to seat in said retainer cavity of said finger holder, said retainer having an axial projection on said one end seating in said retainer recess of said finger holder, said retainer also having projection about its periphery extending transversely of said principal axis and through apertures in said bifurcated end portions of said fingers to seat them thereon; and (v) releasable retainer engaging means securing said retainer in said cavity with said projections and its periphery also being disposed therein to trap said bifurcated end portions of said fingers on said projections.

16. The combination in accordance with claim 15 wherein each said finger includes a metallic spring element in said bifurcated end portion, said finger being molded with said spring element therein.

17. The combination in accordance with claim 15 wherein said bifurcated end portions of said fingers have a retainer aperture therein at the lower end of said arms and a relatively narrow channel extending from said aperture to a wider channel between said arms, said retainer aperture seating said projection on said retainer.

18. The combination in accordance with claim 15 wherein said retainer has two axial projections on said one end seating in two retainer recesses in said holder, and wherein said peripheral projections in said retainer are pins.

19. The combination in accordance with claim 15 wherein said finger has an other end portion tapering to a reduced width at its lower end.

20. The combination in accordance with claim 15 wherein said retainer engaging means comprises an elongated threaded fastener extending axially thereof and threadably and adjustably engaged in an axial recess in said holder, whereby said fastener may be rotated to allow said retainer to move axially outwardly of said cavity to permit replacement of said fingers on said projections thereof.

21. A grid finger assembly for a carton filling machine comprising:

(a) a finger holder adapted to be secured to a support structure;

(b) an elongated finger formed from a flexible, form retaining synthetic resin and depending from said finger holder, said finger having (i) a generally planar upper end portion seated in said finger holder and (ii) an elongated body portion depending therefrom and extending at an angle to the plane of said upper end portion, said finger having a generally planar metallic spring element embedded in the resin of said upper end portion, and said finger body portion flexing about said upper end portion with said spring element flexing. therewith; and (c) releasable means securing said upper end portion of said finger to said finger holder.

22. The grid finger assembly in accordance with claim 21 wherein four fingers are equiangularly disposed about the principal axis of said holder.

23. The grid finger assembly in accordance with claim 22 wherein said body portions of said fingers are of generally V-shaped configuration with the apex of the V-shaped cross section diverging from said principal axis of said holder.

24. The grid finger assembly in accordance with claim 21 wherein said upper end portion of said finger, including the upper end of said spring element, is bifurcated to provide a slot and wherein a portion of said securing means extends through said slot.

* * * * *